US011349231B2

(12) United States Patent
Katoh et al.

(10) Patent No.: US 11,349,231 B2
(45) Date of Patent: May 31, 2022

(54) TERMINAL, AND MOUNTING STRUCTURE OF TERMINAL AND MOUNTING SURFACE

(71) Applicant: YAZAKI CORPORATION, Tokyo (JP)

(72) Inventors: Hiroshi Katoh, Makinohara (JP); Jin Watanabe, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/037,710

(22) Filed: Sep. 30, 2020

(65) Prior Publication Data

US 2021/0098908 A1 Apr. 1, 2021

(30) Foreign Application Priority Data

Sep. 30, 2019 (JP) ..... JP2019-179433

(51) Int. Cl.
*H01R 11/12* (2006.01)
*H01R 4/64* (2006.01)

(52) U.S. Cl.
CPC ..... *H01R 11/12* (2013.01); *H01R 4/64* (2013.01)

(58) Field of Classification Search
CPC ..... H01R 11/12
See application file for complete search history.

(56) References Cited

U.S. PATENT DOCUMENTS

| | | | | |
|---|---|---|---|---|
| 4,983,133 | A * | 1/1991 | Van Scyoc | H01R 11/12 439/860 |
| 9,178,288 | B2 * | 11/2015 | Gao | H05K 3/325 |
| 9,774,104 | B2 * | 9/2017 | Kitagawa | H01R 4/48 |
| 11,031,904 | B2 * | 6/2021 | Andrews | H02S 40/34 |
| 2011/0130054 | A1 | 6/2011 | Lamoureux et al. | |
| 2014/0360749 | A1 | 12/2014 | Gao et al. | |
| 2017/0222336 | A1 | 8/2017 | Kitagawa | |
| 2017/0229796 | A1 | 8/2017 | Kitagawa | |

FOREIGN PATENT DOCUMENTS

| | | | |
|---|---|---|---|
| JP | 9-147934 | A | 6/1997 |
| WO | 2010/012872 | A1 | 2/2010 |

* cited by examiner

*Primary Examiner* — Ross N Gushi
(74) *Attorney, Agent, or Firm* — Kenealy Vaidya LLP

(57) ABSTRACT

A terminal is mounted on a mounting surface having a stud bolt standing on the mounting surface. The terminal having: a contact portion configured to contact with the mounting surface; an insertion portion allowing the stud bolt to be inserted to the insertion portion; and an elastic portion connected to the contact portion and extending in a direction to leave the mounting surface. The elastic portion is configured to urge the contact portion elastically toward the mounting surface when he terminal touches a fixture engaged with the stud bolt.

9 Claims, 5 Drawing Sheets

TERMINAL, AND MOUNTING STRUCTURE OF TERMINAL AND MOUNTING SURFACE

CROSS-REFERENCE TO RELATED APPLICATIONS

This application is based on and claims priority under 35 USC 119 from Japanese Patent Application No. 2019-179433 filed on Sep. 30, 2019, the contents of which are incorporated herein by reference.

TECHNICAL FIELD

The present invention relates to a terminal, and a mounting structure between the terminal and a mounting surface.

BACKGROUND ART

In the background art, terminals have been proposed in order to be used for grounding various electric parts mounted on a vehicle to a vehicle body frame or the like of the vehicle. For example, one of the terminals in the background art has a contact portion (having a so-called round shape) provided with a through hole. The terminal is disposed so that the through hole is put on top of a mounting hole formed in the vehicle body frame of the vehicle. In this state, the contact portion is pressed against the vehicle body frame by a dedicated mounting member which is inserted into the through hole and the mounting hole. Thus, the terminal can be mounted on the vehicle body frame.

As for details of the above terminal, refer to JP 9-147934 A.

SUMMARY OF INVENTION

It is considered that the aforementioned background-art terminal has a merit since it can omit fastening work in comparison with a case where the terminal is fastened to the vehicle body frame by means of a bolt or the like. However, in order to put the terminal to practical use, it is necessary to provide a dedicated mounting hole corresponding to the shape of the mounting member in each earth point of the vehicle body frame of the vehicle. In addition, the mounting member itself has a complicated shape suitable for the aforementioned mounding. Accordingly, substantially many man-hours are required for processing the mounting hole or the mounting member. Further, high-level dimensional accuracy is required in the mounting hole or the mounting member so that a proper value can be kept as the force with which the terminal is pressed against the vehicle body frame (corresponding to fastening torque in a case of fastening with a bolt) in order to secure the reliability of electric connection. Consequently, it is considered that the background-art terminal has a demerit since it can increase the man-hours or the maintenance cost when it is in practical use.

Aspect of non-limiting embodiments of the present disclosure relates to provide a terminal capable of reducing the man-hours and the cost in use, and a mounting structure between the terminal and a mounting surface.

According to an aspect of the present disclosure, there is provided a terminal to be mounted on a mounting surface having a stud bolt standing on the mounting surface, the terminal comprising:

a contact portion configured to contact with the mounting surface;

an insertion portion allowing the stud bolt to be inserted to the insertion portion; and an elastic portion connected to the contact portion and extending in a direction to leave the mounting surface, the elastic portion being configured to urge the contact portion elastically toward the mounting surface upon the terminal touching a fixture engaged with the stud bolt.

According to another aspect of the present disclosure, there is provided a mounting structure of a terminal and a mounting surface, the structure comprising:

a mounting surface having a stud bolt standing on the mounting surface; and a terminal mounted on the mounting surface, the terminal having a contact portion contacting with the mounting surface, an insertion portion allowing the stud bolt to be inserted to the insertion portion, and an elastic portion connected to the contact portion and extending in a direction to leave the mounting surface, the contact portion being elastically urged toward the mounting surface and pressed against the mounting surface due to the terminal touching a fixture engaged with the stud bolt.

DESCRIPTION OF EMBODIMENTS

Figure 1:
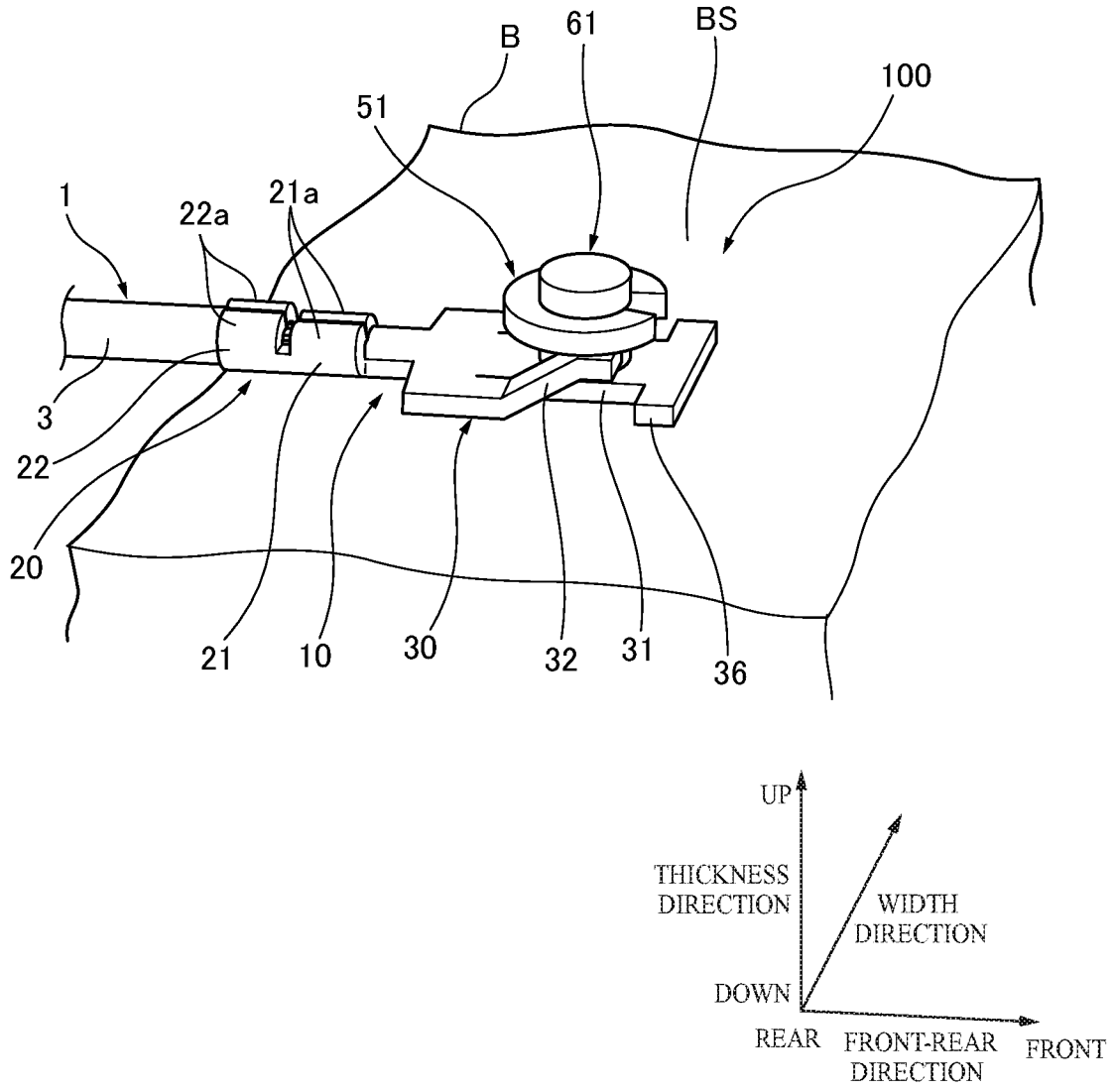
FIG. 1 is a perspective view showing a state where a terminal according to an embodiment of the invention has been mounted on a mounting piece.

A terminal 10, and a mounting structure 100 between the terminal 10 and a mounting surface BS will be described below with reference to the drawings. In the following description, for convenience of explanation, "front/rear direction", "width direction", "thickness direction", "front", "rear". "left", "right", "up" and "down" are defined as shown in the drawings. "Front/rear direction", "left right direction" and "up/down direction" cross one another.

Figure 2:
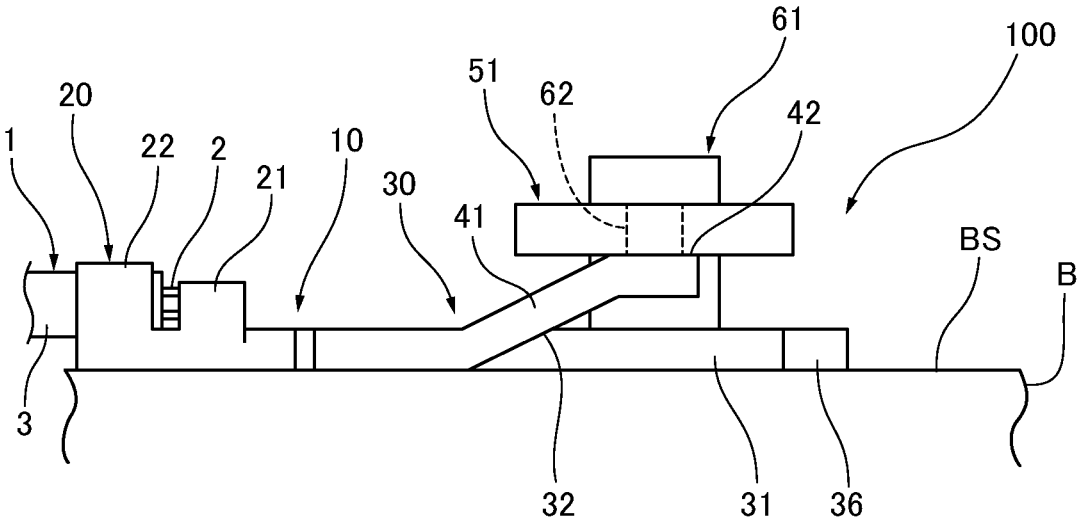
FIG. 2 is a side view showing the state where the terminal according to the embodiment has been mounted on the mounting piece.
Figure 3:
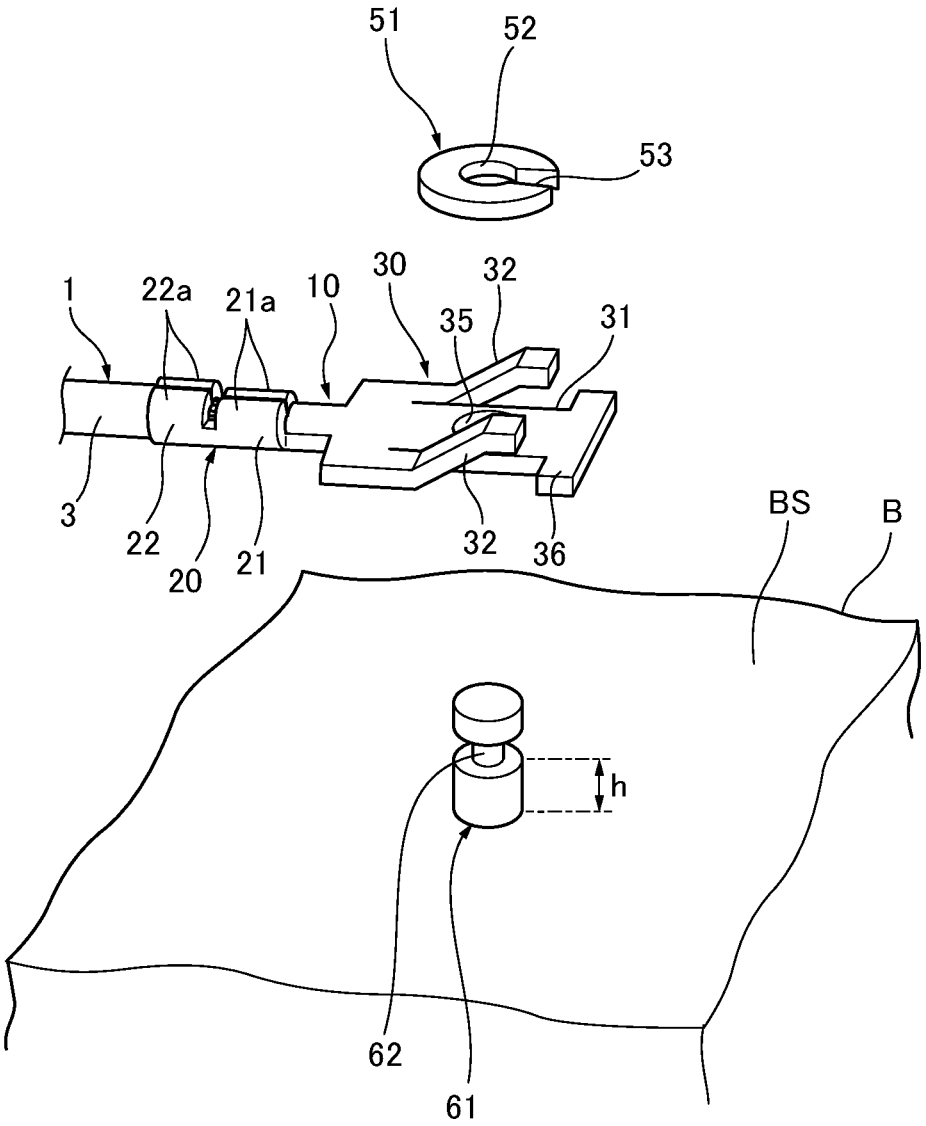
FIG. 3 is a perspective view of the terminal according to the embodiment, the mounting piece, and a washer.

As shown in FIG. 1 to FIG. 3, the terminal 10 according to the embodiment is connected to an end portion of an electric wire 1. The terminal 10 is, for example, mounted on a mounting surface BS of a vehicle body frame B of a vehicle such as an automobile so as to secure electric conduction thereto. The electric wire 1 is, for example, a ground wire for grounding various electric parts mounted on the vehicle. That is, the terminal 10 is a ground terminal to which the electric wire 1 for ground has been connected. The terminal 10 is fixed to a stud bolt 61 by a washer 51 (fixture). The stud bolt 61 is erectly provided on the mounting surface BS of the vehicle frame B of the vehicle.

The electric wire 1 has a conductor core wire 2, and an insulating coating 3 covering the circumference of the conductor core wire 2. The conductor core wire 2 is constituted by a bundle of a plurality of strands made of copper, a copper alloy, aluminum, an aluminum alloy or the like. The insulating coating 3 is made of a resin material having flexibility and insulation. In the end portion of the electric wire 1, the insulating coating 3 is removed to exposed a part of the conductor core wire 2.

The terminal 10 has an electric wire connection portion 20 and a fixation portion 30. The terminal 10 is, for example, manufactured by press working on a plate made of an electrically conductive metal material such as stainless steel, copper, or a copper alloy.

The electric wire connection portion 20 has a conductor crimping portion 21, and a coating crimping portion 22. The conductor crimping portion 21 has a pair of conductor crimping pieces 21*a*, and the coating crimping portion 22 has a pair of coating crimping pieces 22*a*. In the electric wire connection portion 20, the conductor crimping pieces 21*a* are fixed to the conductor core wire 2 of the electric wire 1 by crimping, and the coating crimping pieces 22*a* are fixed to the insulating coating 3 of the electric wire 1 by crimping. Thus, the terminal 10 and the electric wire 1 are coupled with each other so as to secure electric conduction between the terminal 10 and the conductor core wire 2 of the electric wire 1.

Figure 4:
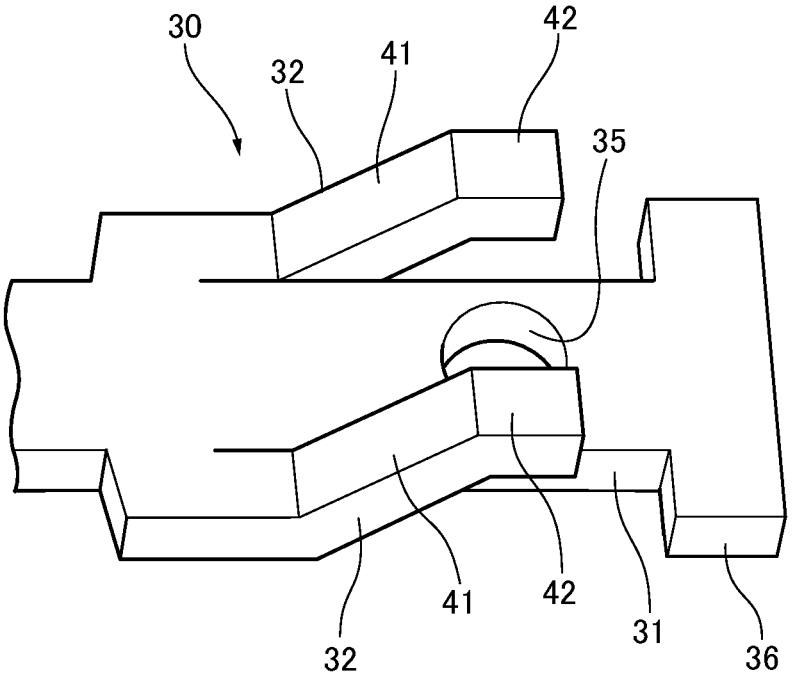
FIG. 4 is a perspective view showing a fixation portion of the terminal.
Figure 5A:
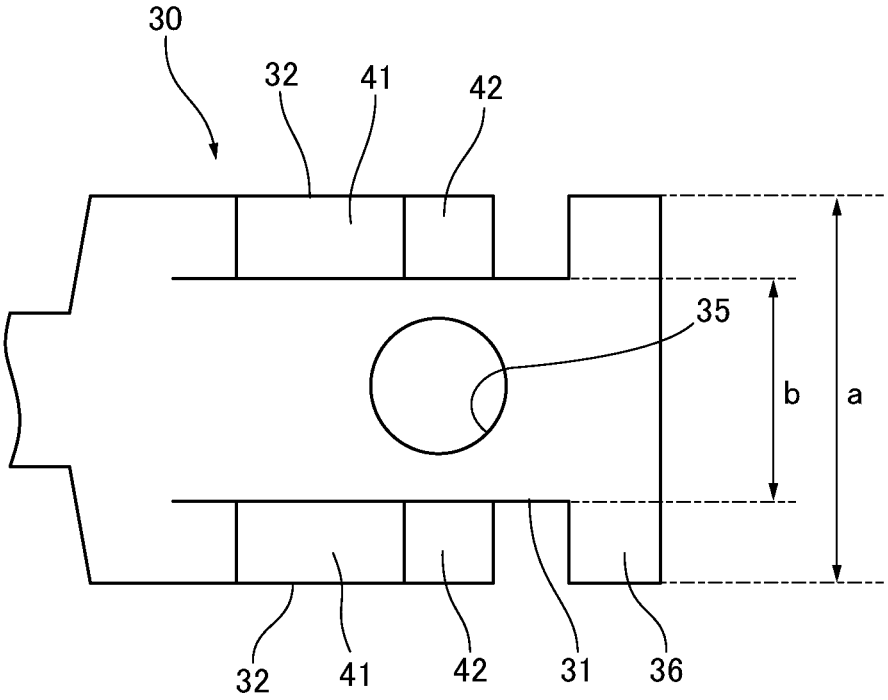
FIG. 5A and FIG. 5B are views showing the fixation portion of the terminal, FIG. 5A being a plan view, FIG. 5B being a side view.
Figure 5B:
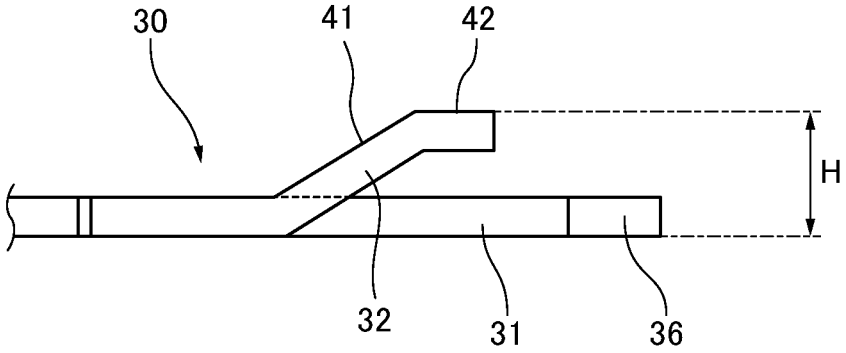

As shown in FIG. 4, FIG. 5A and FIG. 5B, the fixation portion 30 of the terminal 10 is formed like a plate, including a contact portion 31, and a pair of arm portions 32 (elastic portions) connected to the contact portion 31.

At the substantial center of the contact portion 31, an insertion hole 35 (insertion portion) is provided. In addition, at a distal end of the contact portion 31, an extension portion 36 is provided to be connected to the contact portion 31 and expanded in the width direction (the illustrated up/down direction) from the contact portion 31. The width-direction size a of the extension portion 36 is larger than the width-direction size b of a part of the contact portion 31 where the insertion hole 35 is provided.

The arm portions 32 are provided in opposite edge portions of the contact portion 31 in the width direction. The arm portions 32 are coupled with the rear side (that is, the electric wire connection portion 20 side) of the contact portion 31 so as to extend to the front side (that is, the extension portion 36 side) along the opposite edge portions of the contact portion 31. Each arm portion 32 has a cantilever-like inclined piece portion 41 which is inclined upward and extends toward the front from the place where the arm portion 32 is coupled with the contact portion 31. The distal end part of the inclined piece portion 41 is bent toward the front to from a touch portion 42 substantially parallel with the contact portion 31. The touch portions 42 are disposed to hold the insertion hole 35 formed in the contact portion 31, therebetween in the width direction in planar view as shown in FIG. 5A. In addition, in a state where the terminal 10 has not been mounted on the mounting surface BS, the top face of each touch portion 42 and the bottom face of the contact portion 31 are separated by initial height H as shown in FIG. 5B.

As shown in FIG. 3, the stud bolt 61 erectly provided on the mounting surface BS of the vehicle body frame B has a shape like a round bar slightly smaller in diameter than the insertion hole 35 formed in the contact portion 31 of the terminal 10. A neck portion 62 further smaller in diameter than any other part of the stud bolt 61 is provided near the distal end portion of the stud bolt 61. The lower-side (that is, mounting surface BS side) side face of the neck portion 62 and the mounting surface BS are separated from each other by height h. The height h is smaller than the initial height H of the top face of each touch portion 42. That is, the relation "initial height H>height h" is established.

The washer 51 is, for example, formed out of a metal plate. A retention hole portion 52 having a substantially circular shape is provided in a central portion of the washer 51. The inner diameter of the retention hole portion 52 is smaller than the outer diameter of the stud bolt 61 and slightly larger than the outer diameter of the neck portion 62. The washer 51 has a notch portion 53 communicating with the retention hole portion 52 through one circumferential place. The width of the notch portion 53 is slightly smaller than the outer diameter of the neck portion 62 of the stud bolt 61.

In order to mount the terminal 10 on the vehicle body frame B, the stud bolt 61 is first inserted into the insertion hole 35 of the contact portion 31 in a state where the bottom face of the contact portion 31 has been set to face the mounting surface BS of the vehicle body frame B. Then the terminal 10 is made close to the mounting surface BS until the bottom face of the contact portion 31 of the terminal 10 abuts against the mounting surface BS. At this time, the top face (initial height H) of each touch portion 42 is located above the lower face (height h) of the neck portion 62.

Next, as shown in FIG. 2, the washer 51 is fitted to the neck portion 62 from the rear side in a state where the notch portion 53 has been set to face the neck portion 62 of the stud bolt 61 inserted into the insertion hole 35 of the contact portion 31. Thus, the notch portion 53 of the washer 51 is expanded by the neck portion 62 while the neck portion 62 passing through the notch portion 53 enters into the retention hole portion 52. As a result, the washer 51 is engaged with the neck portion 62 in the state where the neck portion 62 of the stud bolt 61 has entered into the retention hole portion 52 of the washer 51.

Here, since the height h of the lower face of the neck portion 62 is smaller than the initial height H of the top face of each touch portion 42, the washer 51 touches the touch portions 42 of the arm portions 32 when the washer 51 is engaged with the stud bolt 61. When the washer 51 is further inserted toward the neck portion 62, the washer 51 deforms the arm portions 32 downward elastically. Then, due to urging force applied to the contact portion 31 by the arm portions 32, the contact portion 31 is pressed against the mounting surface BS. Thus, the terminal 10 is mounted on the vehicle body frame B while keeping itself in close contact with the mounting surface BS. Thus, electric conduction is established between the conductor core wire 2 of the electric wire 1 and the vehicle body frame B. In order to secure proper electric conduction, the difference between the initial height H and the height h (=H−h) can be determined by various experiments in advance so that the urging force with which the arm portions 32 press the contact portion 31 against the mounting surface BS exceeds a predetermined threshold to secure the reliability of electric connection.

The mounting structure 100 between the terminal 10 and the mounting surface BS is completed through the aforementioned process.

In order to remove the terminal 10 mounted on the mounting surface BS, the washer 51 engaged with the neck portion 62 of the stud bolt 61 is separated from the stud bolt 61 while sliding to the front. After that, the contact portion 31 is extracted from the stud bolt 61. In this manner, the terminal 10 can be removed from the mounting surface BS easily.

As described above, according to the terminal 10 and the mounting structure 100 of the terminal 10 according to the present embodiment, the washer 51 is engaged with the stud bolt 61 erectly provided on the mounting surface BS in the state where the stud bolt 61 has been inserted into the insertion portion 35 of the contact portion 31, so that the arm portions 32 touching the washer 51 urges the contact portion 31 toward the mounting surface BS. Thus, the terminal 10 is mounted on the mounting surface BS in the state where the contact portion 31 has been pressed against the mounting surface BS. Thus, the terminal 10 can be mounted on the mounting surface BS by the engagement of the washer 51 with the stud bolt 61 without requiring fastening work using a bolt or the like. Further, the reliability of electric connection can be secured as long as the urging force with which the arm portions 32 press the contact portion 31 against the mounting surface BS exceeds the threshold value. Accordingly, excessive dimensional accuracy is not required in the terminal 10, and torque control during the mounting can be also omitted. Thus, the terminal 10 can reduce the man-hours or the cost in use in comparison with a background-art terminal 10.

Further, the plurality of arm portions 32 are disposed to hold therebetween the insertion portion 35 provided in the contact portion 31. Accordingly, due to the urging force applied to the contact portion 31 by the plurality of arm portions 32 individually, the inclination or floating of the contact portion 31 around the insertion portion 35 (that is, around the stud bolt 61) can be inhibited. As a result, the contact area with the mounting surface BS can be suppressed from decreasing due to the inclination or the like of the contact portion 31, so that the reliability of electric connection between the terminal 10 and the mounting surface BS can be further improved.

Furthermore, the aforementioned inclination or the like of the contact portion 31 can be further firmly suppressed by the extension portion 36 expanded in the width direction (that is, in the direction in which the plurality of arm portions 32 hold the insertion portion 35 therebetween) from the contact portion 31. Accordingly, the terminal 10 can bring the contact portion 31 into more proper contact with the mounting surface BS so that the reliability of the electric connection can be further improved.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

For example, the terminal 10 is used as a ground terminal in the aforementioned embodiment. However, the terminal 10 does not have to be used as a ground terminal, but may be, for example, used as a power terminal for feeding electric power to various electric parts.

Further, the terminal 10 may have a notch-like insertion portion in the contact portion 31 in place of the insertion hole 35. That is, as long as the terminal 10 has an insertion portion allowing a stud bolt to be inserted thereto in the thickness direction, the terminal 10 is not particularly limited as to having the specific shape of the insertion portion or the like. Further, the insertion portion may be provided at a different place from the contact portion 31. In addition, the terminal 10 may have an elastic portion like a double-supported beam in place of the cantilever-like arm portions 32, or may have a coil-like spring extending upward from the top face of the contact portion 31. That is, as long as the terminal 10 has an elastic portion capable of touching the washer 51 to generate urging force, the terminal 10 is not particularly limited as to having the specific shape of the elastic portion or the like. In the same manner, as long as the washer 51 functions as a fixture capable of touching the terminal 10 to deform the elastic portion when the washer 51 is engaged with the stud bolt 61, the washer 51 is not particularly limited as to its specific shape or the like. In the same manner, the engagement portion (neck portion 62) allowing the washer 51 to be engaged with the stud bolt 61 is not particularly limited as to its specific shape or the like.

Further, in the aforementioned embodiment, the contact portion 31 is used as a main electric contact with the mounting surface BS, and the arm portions 32 can leave the mounting surface BS and touch the washer 51. However, for example, contrary to the aforementioned embodiment, the arms portion 32 (particularly the touch portions 42 which are free ends of the arm portions 32) may be used as electric contacts with the mounting surface BS. In this case, the terminal 10 and the mounting surface BS are assembled so that the contact portion 31 can leave the mounting surface BS to touch the washer 51.

According to the above exemplary embodiments, the terminal (10) is to be mounted on a mounting surface (BS) having a stud bolt (61) standing on the mounting surface (BS), the terminal comprising:

a contact portion (31) configured to contact with the mounting surface (BS);

an insertion portion (35) allowing the stud bolt (61) to be inserted to the insertion portion (35); and an elastic portion (32) connected to the contact portion (31) and extending in a direction to leave the mounting surface (BS), the elastic portion (32) being configured to urge the contact portion (31) elastically toward the mounting surface (BS) upon the terminal touching a fixture (51) engaged with the stud bolt (61).

According to the terminal having the aforementioned configuration, when the stud bolt erectly provided on the mounting surface is engaged with the fixture (such as a washer) in use of the terminal in a state where the stud bolt has been inserted into the insertion portion, the terminal touches the fixture so that the elastic portion urges the contact portion elastically toward the mounting surface. Thus, the terminal is mounted on the mounting surface in a state where the contact portion has been pressed against the mounting surface. Accordingly, the terminal can be mounted on the mounting surface by the engagement of the fixture, such as a washer which is generally used, with the stud bolt without requiring fastening work using a bolt or the like. Further, the reliability of electric connection can be secured as long as the urging force with which the elastic portion presses the contact portion against the mounting surface (corresponding to fastening torque in case of fastening with a bolt) exceeds a predetermined threshold value. Accordingly, excessive dimensional accuracy is not required in the terminal, and torque control during the mounting can be also omitted. Thus, the terminal according to the configuration can reduce the man-hours or the cost in use in comparison with a background-art terminal.

The aforementioned terminal may further comprising a plurality of the elastic portions (32), the insertion portion (35) is provided in the contact portion (31), and one of the plurality of the elastic portions (32) and another of the plurality of the elastic portions (32) are located to sandwich the insertion portion (35) in a predetermined direction.

According to the terminal having the aforementioned configuration, the plurality of elastic portions are disposed to hold therebetween the insertion portion provided in the contact portion. Accordingly, due to the urging force applied to the contact portion by the plurality of elastic portions individually, the inclination or floating of the contact portion around the insertion portion (that is, around the stud bolt) can be inhibited. As a result, the contact area with the mounting surface can be suppressed from decreasing due to the inclination or the like of the contact portion, so that the reliability of electric connection between the terminal and the mounting surface can be further improved.

The aforementioned terminal may further comprising an extension portion (36) extended from the contact portion (31) in the predetermined direction to contact with the mounting surface (BS).

According to the terminal having the aforementioned configuration, the aforementioned inclination or the like of the contact portion can be further firmly suppressed by the extension portion expanded in the predetermined direction (that is, in the direction in which the plurality of elastic portions hold the insertion portion therebetween) from the contact portion. Accordingly, the terminal having the configuration can bring the contact portion into more proper contact with the mounting surface so that the reliability of the electric connection can be further improved.

According to the above exemplary embodiments, a mounting structure (100) of a terminal and a mounting surface (BS), comprising:

a mounting surface (BS) having a stud bolt (61) standing on the mounting surface (BS); and a terminal mounted on the mounting surface (BS), the terminal having a contact portion (31) contacting with the mounting surface (BS), an insertion portion (35) allowing the stud bolt (61) to be inserted to the insertion portion (35), and an elastic portion (32) connected to the contact portion (31) and extending in a direction to leave the mounting surface (BS), the contact portion (31) being elastically urged toward the mounting surface (BS) and pressed against the mounting surface (BS) due to the terminal touching a fixture (51) engaged with the stud bolt (61).

According to the mounting structure between the terminal and the mounting surface, when the stud bolt erectly provided on the mounting surface is engaged with the fixture (such as a washer) in a state where the stud bolt has been inserted into the insertion portion, the terminal touches the fixture so that the elastic portion urges the contact portion elastically toward the mounting surface. Thus, the terminal is mounted on the mounting surface in a state where the contact portion has been pressed against the mounting surface. Accordingly, the terminal can be mounted on the mounting surface by the engagement of the fixture, such as a washer which is generally used, with the stud bolt without requiring fastening work using a bolt or the like. Further, the reliability of electric connection can be secured as long as the urging force with which the elastic portion presses the contact portion against the mounting surface (corresponding to fastening torque in case of fastening with a bolt) exceeds a predetermined threshold value. Accordingly, excessive dimensional accuracy is not required in the terminal, the stud bolt and the fixture, and torque control during the mounting can be also omitted. Thus, the mounting structure having the configuration can reduce the man-hours or the cost in use in comparison with a mounting structure with a background-art terminal.

According to the present invention, it is possible to provide a terminal capable of reducing the man-hours or the cost in use, and a mounting structure between the terminal and a mounting surface.

What is claimed is:

1. A terminal to be mounted on a mounting surface having a stud bolt standing on the mounting surface, the terminal comprising:

a contact portion configured to contact with the mounting surface, the contact portion includes a flat plate;

an insertion portion allowing the stud bolt to be inserted to the insertion portion;

first and second elastic portions connected to the contact portion and extending in a direction to leave the mounting surface, the elastic portions being configured to urge the contact portion elastically toward the mounting surface upon the terminal touching a fixture engaged with the stud bolt, and the elastic portions are spaced away from the insertion portion; and an extension portion extending from the contact portion in a predetermined direction in a plan view of the terminal, the extension portion has a first edge and a second edge spaced apart from the first edge by a first distance in the predetermined direction, the contact portion has a third edge and a fourth edge spaced apart from the third edge by a second distance in the predetermined direction, the second distance is less than the first distance, a first elastic portions has a fifth edge and the second elastic portion has a sixth edge spaced apart from the fifth edge by the first distance in the predetermined direction, and the extension portion includes a seventh edge that extends in a straight line from the first edge to the second edge in the predetermined direction.

2. The terminal according to claim 1, wherein the insertion portion is provided in the contact portion, and the insertion portion is located between the first elastic portion and the second elastic portion in the predetermined direction.

3. The terminal according to claim 2, wherein the extension portion extends from the contact portion in the predetermined direction to contact with the mounting surface.

4. The terminal according to claim 1, wherein the contact portion has a first end and a second end, the first and second elastic portions are connected to the first end, the extension portion is connected to the second end, the contact portion extends in a second direction that is orthogonal to the the predetermined direction, such that the contact portion and the extension portion form a T-shape, the insertion portion is located between the first end and the second end of the contact portion, wherein each of the first and second elastic portions includes:

a cantilever-like inclined piece portion that inclines from the contact portion in the direction to leave the mounting surface, and a touch portion that is connected to the inclined piece portion and the touch portion is parallel to the contact portion.

5. A mounting structure of a terminal and a mounting surface, the structure comprising:

a mounting surface having a stud bolt standing on the mounting surface; and a terminal mounted on the mounting surface, the terminal having a contact portion and an extension portion protruding from the contact portion, the contact portion and the extension portion form a T-shaped flat surface that contacts with the mounting surface, the contact portion includes a flat plate, an insertion portion allowing the stud bolt to be inserted to the insertion portion, and an elastic portion connected to the contact portion and extending in a direction to leave the mounting surface, and the elastic portion is spaced away from the insertion portion and the extension portion, the contact portion being elastically urged toward the mounting surface and pressed against the mounting surface due to the terminal touching a fixture engaged with the stud bolt.

6. The mounting structure according to claim 5, wherein the fixture is a washer that has a notch, and the stub bolt has neck that is spaced away from the mounting surface by a predetermined distance, the washer snaps onto the neck, and the washer elastically deforms the elastic portion toward the mounting surface such that the fixture elastically urges and presses the contact portion toward the contact surface.

7. The mounting structure according to claim 6, wherein the extension portion extends from the contact portion a predetermined direction in a plan view of the terminal, the extension portion has a first edge and a second edge spaced apart from the first edge by a first distance in the predetermined direction, the contact portion has a third edge and a fourth edge spaced apart from the third edge by a second distance in the predetermined direction, the second distance is less than the first distance.

8. The mounting structure according to claim 7, wherein the elastic portion includes a first elastic portion and a second elastic portion, the first elastic portion has a fifth edge and the second elastic portion has a sixth edge spaced apart from the fifth edge by the first distance in the predetermined direction, the extension portion includes a seventh edge that extends in a straight line from the first edge to the second edge in the predetermined direction.

9. The mounting structure according to claim 8, wherein the first elastic portion is offset to one side of the T-shaped flat surface and abuts the fixture, and the second elastic portion is offset to a different side of the T-shaped flat surface and abuts the fixture.

* * * * *